US010261439B1

(12) United States Patent
Chuang et al.

(10) Patent No.: US 10,261,439 B1
(45) Date of Patent: Apr. 16, 2019

(54) TONER CARTRIDGE HAVING PERCUSSION DEVICE

(71) Applicant: General Plastic Industrial Co., Ltd., Taichung (TW)

(72) Inventors: Chin-His Chuang, Taichung (TW); Chi-Chin Huang, Taichung (TW)

(73) Assignee: GENERAL PLASTIC INDUSTRIAL CO., LTD., Taichung (TW)

( * ) Notice: Subject to any disclaimer, the term of this patent is extended or adjusted under 35 U.S.C. 154(b) by 0 days.

(21) Appl. No.: 15/810,938

(22) Filed: Nov. 13, 2017

(30) Foreign Application Priority Data

Oct. 13, 2017 (TW) ..... 106135132 A

(51) Int. Cl.
*G03G 15/08* (2006.01)
*G03G 15/10* (2006.01)

(52) U.S. Cl.
CPC ..... *G03G 15/0868* (2013.01); *G03G 15/087* (2013.01); *G03G 15/105* (2013.01); *G03G 2221/1807* (2013.01); *G03G 2221/1869* (2013.01)

(58) Field of Classification Search
CPC ..... G03G 15/087; G03G 15/0834; G03G 2215/0154
See application file for complete search history.

(56) References Cited

U.S. PATENT DOCUMENTS 5,489,976 A * 2/1996 Ichikawa ..... G03G 15/0872 222/DIG. 1
5,970,290 A * 10/1999 Yoshiki ..... G03G 15/0868 399/261
2001/0008594 A1 7/2001 Takano
2002/0106215 A1 8/2002 Ban
2013/0330105 A1 12/2013 Komatsu
2015/0227082 A1 8/2015 Fujii

* cited by examiner

*Primary Examiner* — Victor Verbitsky
(74) *Attorney, Agent, or Firm* — Muncy, Geissler, Olds & Lowe, P.C.

(57) ABSTRACT

A toner cartridge includes a housing, a toner conveying shaft and a percussion device. The housing has a barrel portion, in which toners are contained, and a transmission portion rotatably disposed at an end of the barrel portion. The toner conveying shaft is rotatably disposed inside the barrel portion of the housing and drivenable by the transmission portion of the housing to rotate. The percussion device is configured to intermittently vibrate the barrel portion of the housing when the toner conveying shaft rotates. As such, when the percussion device intermittently vibrates the barrel portion of the housing, the toners attached on an inner wall surface of the barrel portion will be shaken down for being further discharged out of barrel portion, thereby reducing the residual amount of the toners that are contained in the barrel portion of the housing.

11 Claims, 9 Drawing Sheets

TONER CARTRIDGE HAVING PERCUSSION DEVICE

BACKGROUND OF THE INVENTION

1. Field of the Invention

The present invention relates generally to an electronic image-forming apparatus and more particularly, to a toner cartridge used in the electronic image-forming apparatus.

2. Description of the Related Art

Toner cartridge is one of the important structural devices of the electronic image-forming apparatus, and also a technical core for achieving image developing. Though there are various toner cartridges with different structures commercially available to consumers, the goal of perfectly making the toner cartridge with more functions, such as reducing the residual quantity of toners, is still to be reached by manufactures.

SUMMARY OF THE INVENTION

The present invention has been accomplished in view of the above-noted circumstances. It is an objective of the present invention to provide a toner cartridge capable of reducing the residual quantity of toners contained therein.

To attain the above objective, the present invention provides a toner cartridge comprising a housing, a toner conveying shaft, and a percussion device. The housing has a barrel portion for containing toners and a transmission portion rotatably disposed at an end of the barrel portion. The toner conveying shaft is rotatably disposed inside the barrel portion of the housing and drivenable by the transmission portion of the housing to rotate. The percussion device is configured to intermittently vibrate the barrel portion of the housing when the toner conveying shaft rotates.

Preferably, the barrel portion of the housing may have an annular flange, the toner conveying shaft may have a disc portion rotatably received in the annular flange, and the percussion device may comprise a notch provided at the annular flange, and a resilient portion having a resilient arm provided at the disc portion, and a protrusion block disposed at a terminal end of the resilient arm and insertable into the notch. When the resilient portion rotates relative to the barrel portion along with the toner conveying shaft, the protrusion block of the resilient portion intermittently extends into the notch, thereby vibrating the barrel portion of the housing.

Preferably, the barrel portion of the housing may comprise an annular flange, the toner conveying shaft may comprise a shaft portion and a disc portion disposed at an end of the shaft portion and rotatably received in the annular flange, and the percussion device may comprise a notch provided at the disc portion of the toner conveying shaft, and a resilient portion having a resilient arm provided at the annular flange, and a protrusion block disposed at a terminal end of the resilient aim and insertable into the notch. When the disc portion having the notch rotates relative to the barrel portion of the housing along with the toner conveying shaft, the protrusion block of the resilient portion intermittently extends into the notch, thereby vibrating the barrel portion of the housing.

Preferably, the barrel portion of the housing may have an annular flange, the toner conveying shaft may have a disc portion rotatably received in the annular flange, and the percussion device may comprise a notch provided at the annular flange, and a resilient portion having a knocking member and a resilient member disposed between the disc portion and the knocking member in a way that the knocking member partially and intermittently extends into the notch when the resilient portion rotates relative to the barrel portion along with the toner conveying shaft, thereby vibrating the barrel portion of the housing.

With the above-mentioned technical features, when the percussion device intermittently vibrates the barrel portion of the housing, the toners attached on an inner wall surface of the barrel portion will be shaken down for being further discharged out of barrel portion, thereby achieving the effect of reducing the residual quantity of the toners that are contained in the barrel portion of the housing.

BRIEF DESCRIPTION OF THE DRAWINGS

The present invention will become more fully understood from the detailed description given herein below and the accompanying drawings which are given by way of illustration only, and thus are not limitative of the present invention, and wherein.

DETAILED DESCRIPTION OF THE INVENTION

Figure 1:
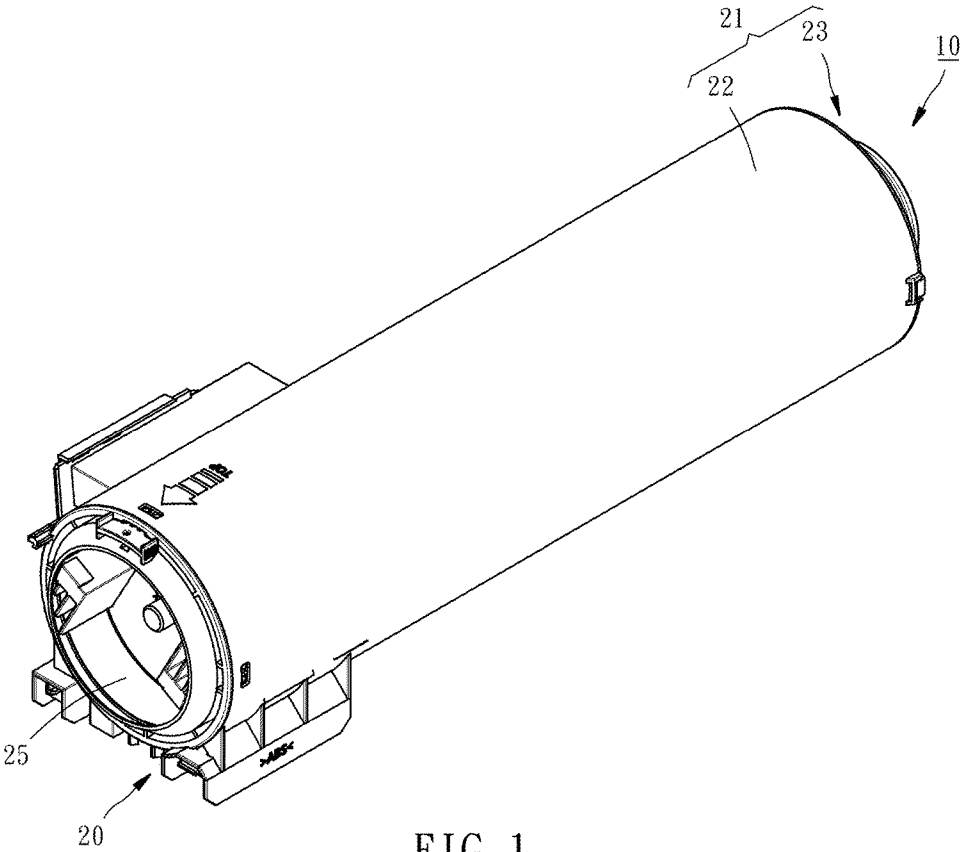
FIG. 1 is a perspective view of a toner cartridge according to a first embodiment of the present invention.
Figure 2:
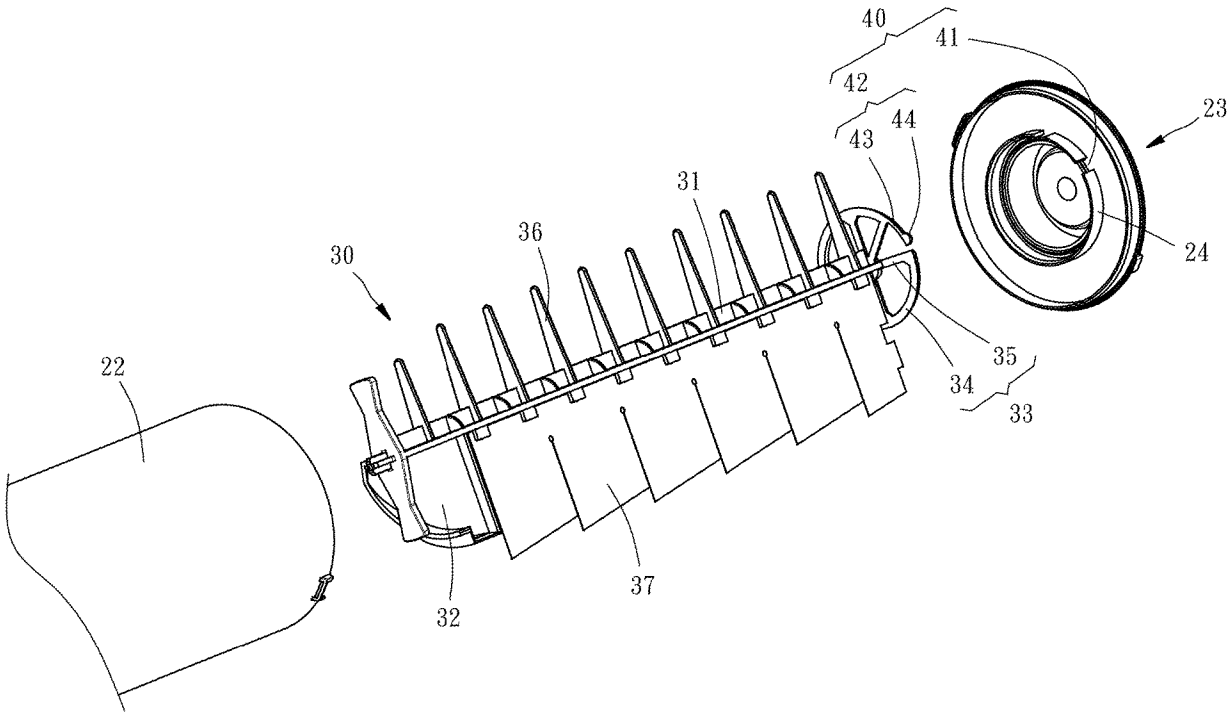
FIG. 2 is an exploded view of the toner cartridge according to the first embodiment of the present invention.

Referring to FIGS. 1 and 2, a toner cartridge 10 provided in accordance with a first embodiment of the present invention comprises a housing 20, a toner conveying shaft 30, and a percussion device 40.

The housing 20 is composed of a barrel portion 21 and a transmission portion 25. The inside of the barrel portion 21 is used to accommodate toners. The barrel portion 21 includes a hollow tube body 22 and an end cap 23. The end cap 23 is fixedly disposed to an end of the tube body 22 and provided at an inner lateral surface thereof with an annular flange 24. The transmission portion 25 is rotatably disposed at the other end of the tube body 22. In other feasible embodiments, the end cap 23 and the tube body 22 may be integrally formed as a unity member.

The toner conveying shaft 30 is rotatably disposed inside the barrel portion 21 of the housing 20. The toner conveying shaft 30 includes a shaft portion 31 having an end connected with the transmission portion 25 of the housing 20, such that the toner conveying shaft 30 is drivenable by the transmission portion 25 of the housing 20 to rotate in the inside of the barrel portion 21 of the housing 20. The toner conveying shaft 30 further includes a scoop portion 32 disposed adjacent to an end of the shaft portion 31 for conveying toners from the barrel portion 21 to the transmission portion 25, and a disc portion 33 disposed at the other end of the shaft portion 31 and rotatably received in the annular flange 24 of the end cap 23 of the housing 20. The disc portion 33 of the toner conveying shaft 30 includes an arc rim 34 and a plurality of spokes 35 connected between the arc rim 34 and the shaft portion 31 of the toner conveying shaft 30. Moreover, the toner conveying shaft 30 further includes a plurality of stirring rods 36 on a lateral side of the shaft portion 31, and a conveying blade 37 on an opposite lateral side of the shaft portion 31. When the toner conveying shaft 30 rotates, the stirring rods 36 stir the toners contained in barrel portion 21, and the conveying blade 37 feeds the toners to the scoop portion 32.

The percussion device 40 includes a notch 41 and a resilient portion 42. In this embodiment, the notch 41 is provided at the annular flange 24 of barrel portion 21 of the housing 20. The resilient portion 42 includes a resilient arm 43 provided at the arc rim 34 of the disc portion 33 of the toner conveying shaft 30, and a protrusion block 44 disposed at a terminal end of the resilient arm 43, such that the resilient portion 42 will rotate along with the toner conveying shaft 30 relative to the barrel portion 21 of the housing 20. In this embodiment, an outer periphery of the resilient arm 43 and an outer periphery of the arm rim 34 are located on an imaginary circumference and combinedly formed as an almost complete circular circumference, and the protrusion block 44 protrudes radially outwardly from the circumference.

Figure 3:
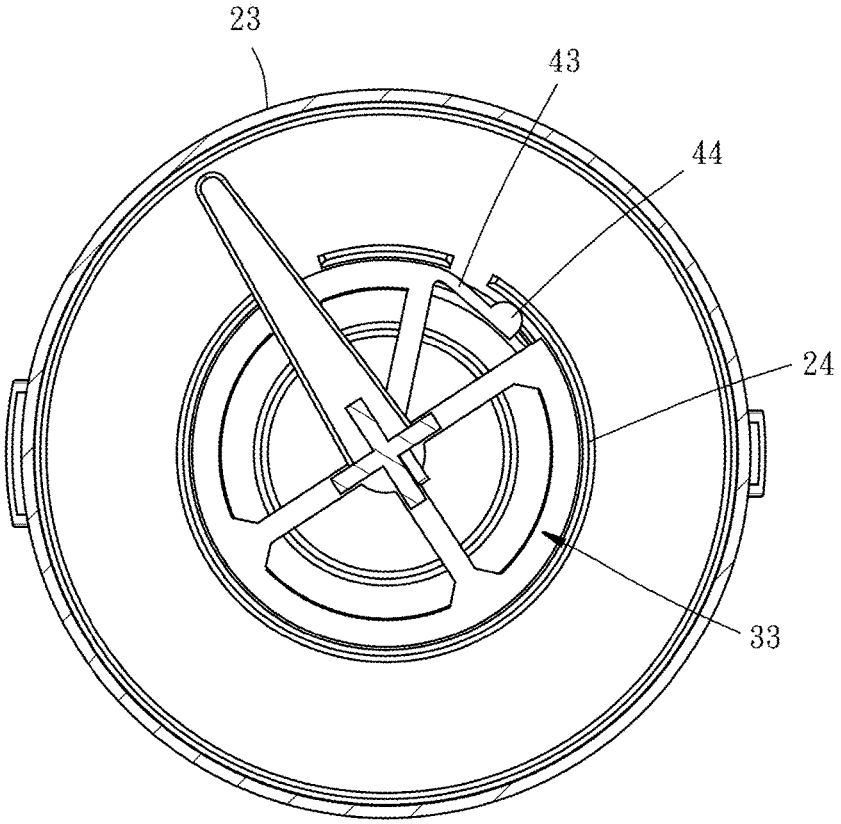
FIG. 3 is a partially sectional view of the toner cartridge according to the first embodiment of the present invention, showing that a protrusion block is departed from a notch.
Figure 4:
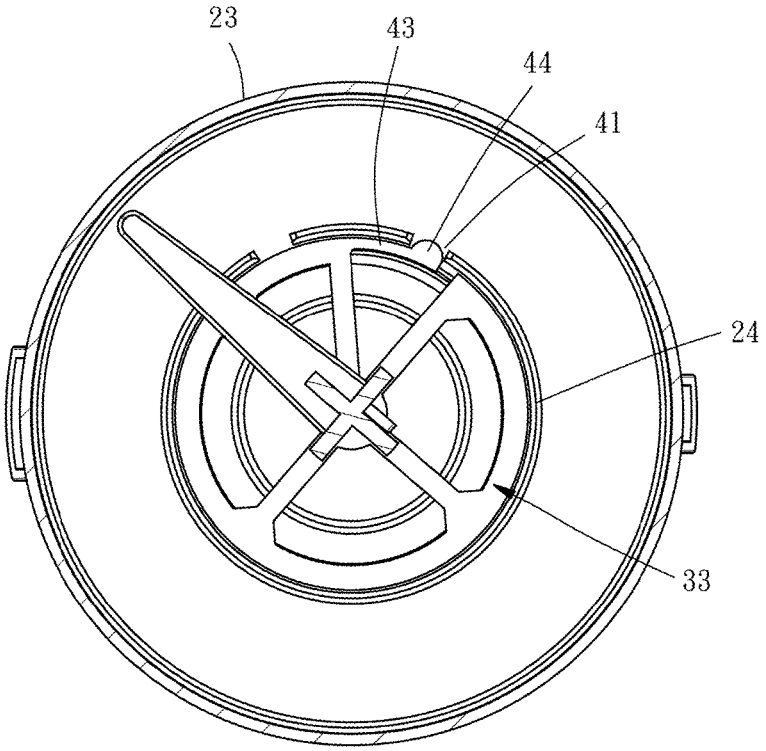
FIG. 4 is similar to FIG. 3, but showing that the protrusion block extends into the notch.

With the above-mentioned structural features, when the toner cartridge 10 is installed in an electronic image-forming apparatus, such as copy machine or printer, the transmission portion 25 of the housing will be driven by a driving member (not shown) of the electronic image-forming apparatus to rotate, such that the toner conveying shaft 30 will be driven by the transmission portion 25 of the housing 20 to rotate relative to the barrel portion 21 of the housing 20. In the rotational period of the toner conveying shaft 30, the resilient portion 42 will rotate along with the disc portion 33 of the toner conveying shaft 30 in a way that the resilient arm 43 is resiliently compressed by an inner wall surface of the annular flange 24 to store a resilient rebound force, as shown in FIG. 3, while the protrusion block 44 is not aimed at the notch 41. As soon as the protrusion block 44 moves to a position corresponding to the notch 41, the protrusion block 44 will extend into the notch 41 due to the resilient rebound force of the resilient arm 43, as shown in FIG. 4, and meantime the resilient arm 43 outwardly knocks on the annular flange 24 to vibrate the barrel portion 21 of the housing 20. When the toner conveying shaft 30 continuously rotates, the barrel portion 21 of the housing 20 will be intermittently vibrated by the percussion device 40. As such, the toners attached on an inner wall surface of the barrel portion 21 will be shaken down due to the intermittent vibration and then discharged out of the housing 10, thereby effectively reducing the residual quantity of the toners that are contained in the barrel portion 21 of the housing 20. In another aspect, the mechanism that the protrusion block 44 is insertable into the notch 41 can provide a positioning effect. For example, in the process of assembling the toner cartridge 10, by means of inserting the protrusion block 44 into the notch 41, the toner conveying shaft 30 can be set at a desired orientation, thereby enabling the toner conveying shaft 30 to be associated with the transmission portion 25 at the desired orientation, facilitating the assembly task of the toner cartridge 10. In this embodiment, the percussion device 40 includes two notches 41. However, the number of the notches 41 is not limited to the disclosure of this embodiment. In other embodiment, the percussion device 40 may include one or more notches 41 in accordance with actual need.

Figure 5:
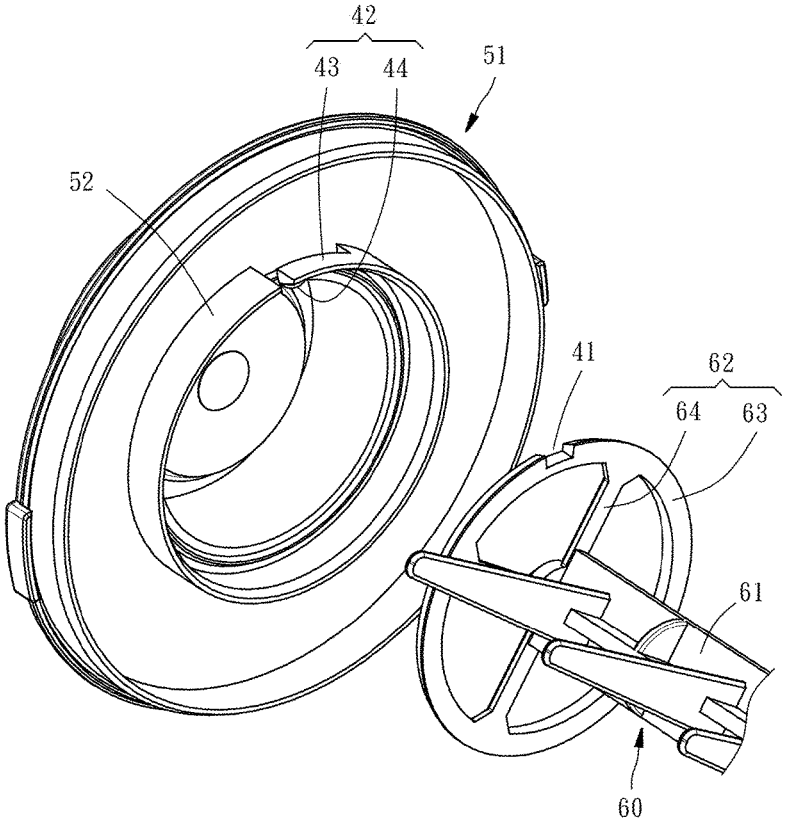
FIG. 5 is a partially exploded view of a toner cartridge according to a second embodiment of the present invention.
Figure 6:
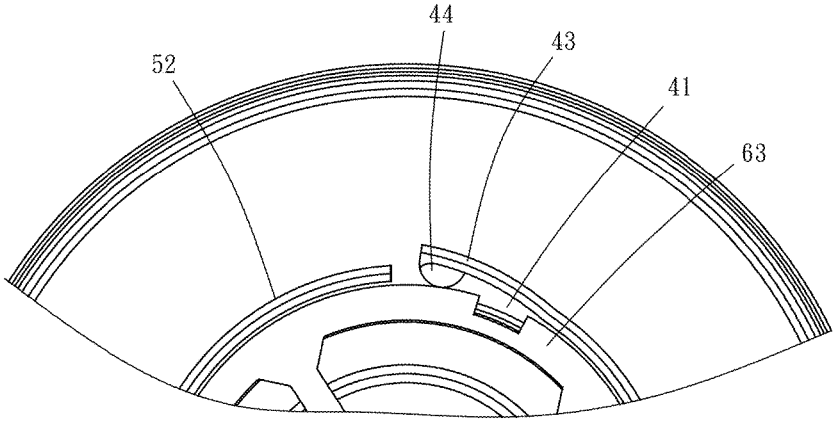
FIG. 6 is a partially sectional view of the toner cartridge according to the second embodiment of the present invention, showing that a protrusion block is departed from a notch.
Figure 7:
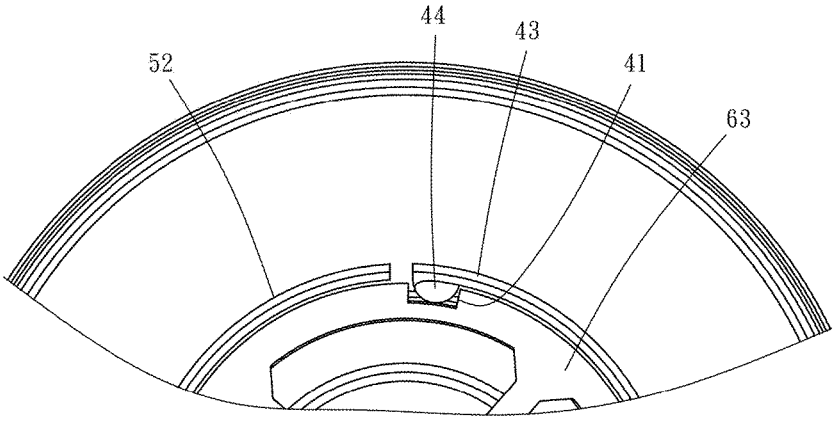
FIG. 7 is similar to FIG. 6, but showing that the protrusion block extends into the notch.

FIG. 5 shows a toner cartridge in accordance with a second embodiment of the present invention, which has a structure basically same as that of the toner cartridge 10 of the first embodiment but with the differences lying in that the end cap 51 has an arch-shaped annular flange 52 provided with the resilient portion 42, and the disc portion 62 of the toner conveying shaft 60 has a circular rim 63 provided with the notch 43, and a plurality of spokes 64 connected between the circular rim 63 and the shaft portion 61 of the toner conveying shaft 60. Specifically, in this embodiment, the notch 41 and the resilient portion 42 of the percussion device 40 are provided at different locations from the first embodiment in a way that the notch 41 is provided at the circular rim 63 of the disc portion 62 of the toner conveying shaft 60, and the resilient arm 43 of the resilient portion 42 is disposed at an end of the annular flange 52 of the end cap 51 and the protrusion block 44 of the resilient portion 42 is disposed at a terminal end of the resilient arm 43. As a result, when the toner conveying shaft 60 rotates, the disc portion 62 having the notch 41 will rotate along with the toner conveying shaft 60. The protrusion block 44 will be pushed outwardly by the outer periphery surface of the circular rim 63 to enable the resilient arm 43 to store a resilient rebound force, as shown in FIG. 6, when the notch 41 and the protrusion block 44 are not aligned with each other. As soon as the notch 41 of the disc portion 62 moves to a position corresponding to the protrusion block 44, the protrusion block 44 will extend into the notch 41 due to the resilient rebound force of the resilient arm 43, as shown in FIG. 7, and in the meantime the resilient arm 43 inwardly knocks on the circular rim 63 to vibrate the toner conveying shaft 60 and the barrel portion 21 of the housing 20. With continuous rotation of the toner conveying shaft 30, the toilers attached on the inner wall surface of the barrel portion 21 will be shaken down due to the intermittent vibration and then discharged out of the housing 10, thereby achieving the effect of reducing the residual quantity of the toners.

Figure 8:
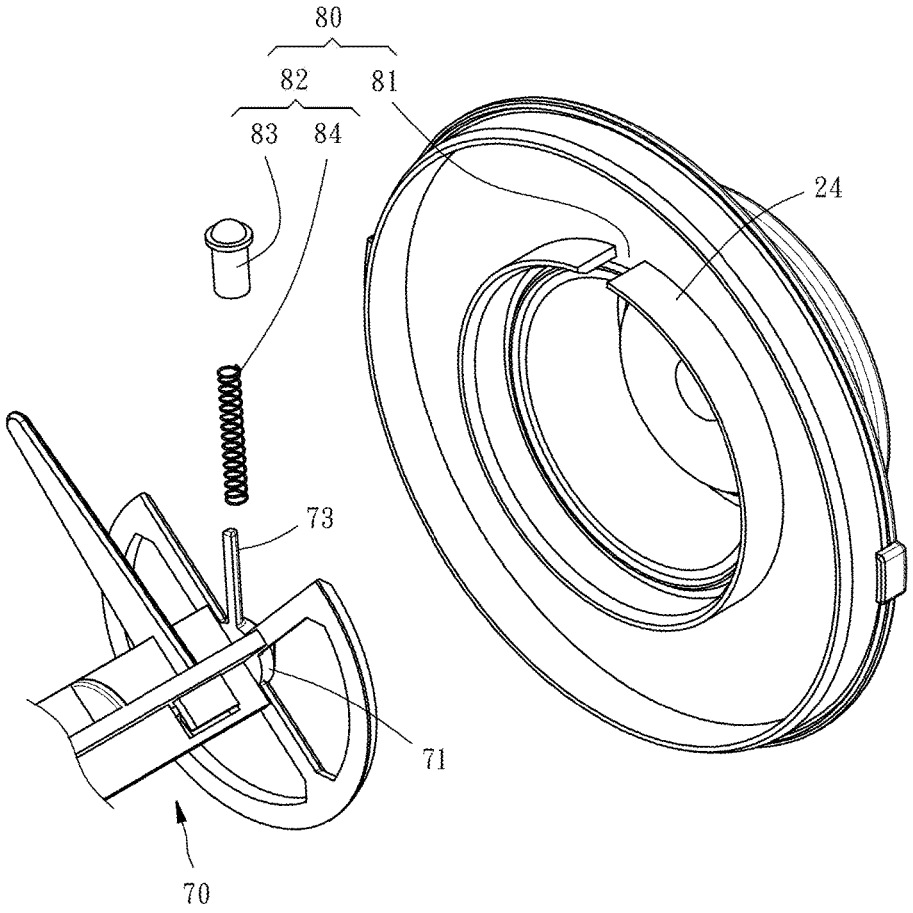
FIG. 8 is a partially exploded view of a toner cartridge according to a third embodiment of the present invention.
Figure 9:
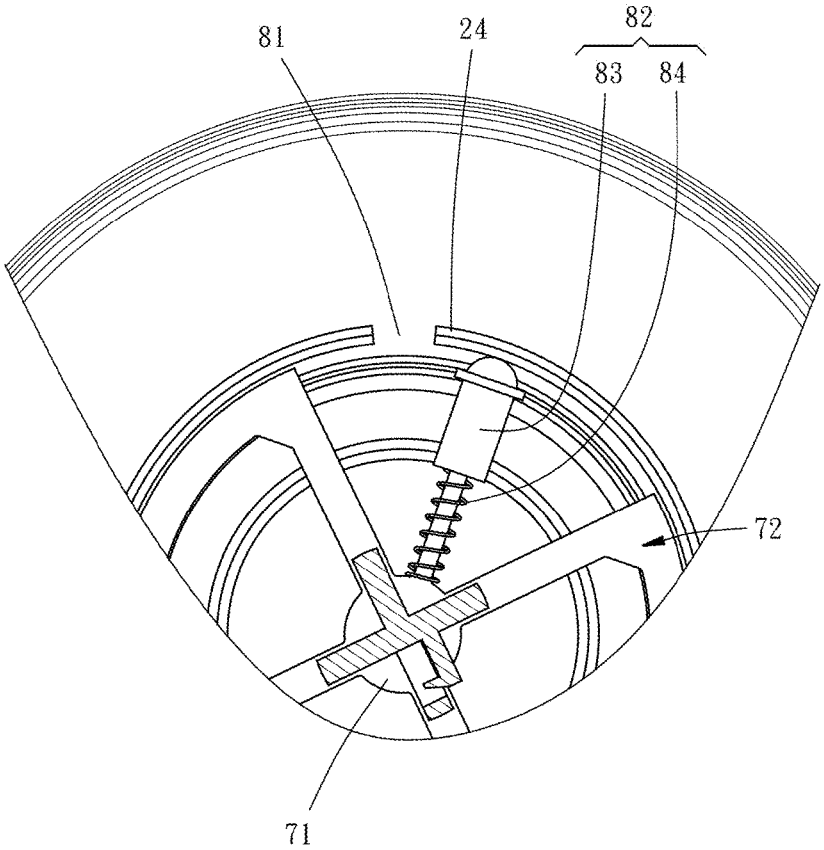
FIG. 9 is a partially sectional view of the toner cartridge according to the third embodiment of the present invention, showing that a knocking member is departed from a notch.
Figure 10:
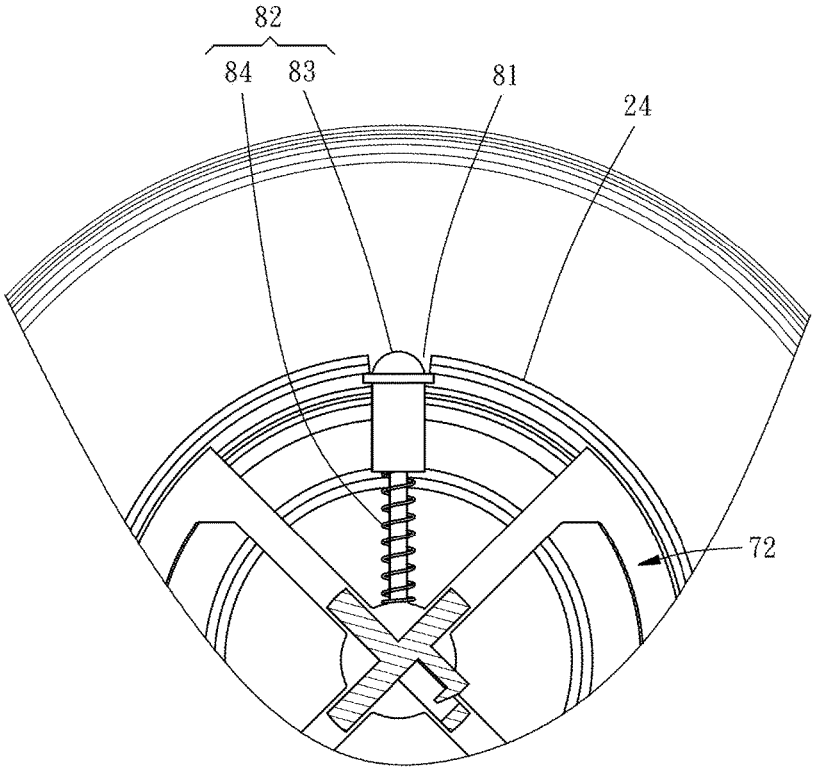
FIG. 10 is similar to FIG. 9, but showing that the knocking member extends into the notch.

FIG. 8 shows a toner cartridge in accordance with a third embodiment of the present invention, which has a housing 20 exactly identical to the housing 20 disclosed by the first embodiment, and a toner conveying shaft 70 and a percussion device 80 different from those disclosed by the first embodiment. Specifically a disc portion 72 of the toner conveying shaft 70 is provided with a radially extending rod 73 having a bottom end connected with a shaft portion 71 of the toner conveying shaft 70. The percussion device 80 has a notch 81 provided at the annular flange 24, and a resilient portion 82 having a knocking member 83 and a resilient member 84. The knocking member 83 is moveably sleeved onto a top end of the radially extending rod 73, and the resilient member 84 is sleeved onto the radially extending rod 73 with its two ends abutting against the shaft portion 71 of the toner conveying shaft 70 and the knocking member 83, respectively. As a result, when the toner conveying shaft 70 rotates, the resilient portion 82 will rotate along with the toner conveying shaft 70. When the notch 81 and the knocking member 83 are not aligned with each other., the knocking member 83 is pressed by the inner wall surface of the annular flange 24, such that the knocking member 83 further compresses the resilient member 84 to enable the resilient member 84 to store a resilient rebound force, as shown in FIG. 9. As soon as the knocking member 83 moves to a position corresponding to the notch 81, the knocking member 83 will be forced by the rebound force of the resilient member 84 to partially extend into the notch 81, as shown in FIG. 10, and in the meantime a part of the knocking member 83 outwardly knocks on the annular flange 24 to vibrate the barrel portion 21 of the housing 20. With continuous rotation of the toner conveying shaft 70, the toners attached on the inner wall surface of the barrel portion 21 will be shaken down due to the intermittent vibration and then discharged out of the housing 10, thereby achieving the effect of reducing the residual quantity of the toners.

Based on the technical features of the present invention, various modifications to the structure of the toner cartridge of the present invention may be made. For example, the structure of the percussion device is not limited to the disclosed embodiments of the present invention. Any percussion device that may rotate along with the toner conveying shaft to intermittently vibrate the housing may be sued. Further, the barrel portion 21 of the housing 20 may provide no such an annular flange 24, but a recessed groove, which is capable of receiving the disc portion 33 and provided at an inner wall surface thereof with the notch 41 or 81, instead. Furthermore, the disc portion 33 or 62 may not be constructed with the arc rim 34 or the circular rim 63 with the spokes 35 or 64, but being configured having a solid disc form, as long as the disc portion can be associated with the annular flange 24.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A toner cartridge, comprising:

a housing having a barrel portion and a transmission portion rotatably disposed at an end of the barrel portion;

a toner conveying shaft rotatably disposed inside the barrel portion of the housing and driven by the transmission portion of the housing to rotate;

a percussion device configured to intermittently vibrate the barrel portion of the housing when the toner conveying shaft rotates;

wherein the percussion device comprises a notch provided at the barrel portion of the housing, and a resilient portion provided at the toner conveying shaft; the resilient portion of the percussion device rotates relative to the barrel portion of the housing along with the toner conveying shaft in a way that a terminal end of the resilient portion intermittently extends into the notch, thereby vibrating the barrel portion of the housing;

wherein the barrel portion of the housing comprises an annular flange extended along an axial direction of the barrel portion of the housing in a way that the notch penetrates through the annular flange along a radial direction of the barrel portion of the housing.

2. The toner cartridge as claimed in claim 1, wherein the toner conveying shaft comprises a shaft portion and a disc portion disposed at an end of the shaft portion and rotatably received in the annular flange.

3. The toner cartridge as claimed in claim 2, wherein the resilient portion of the percussion device comprises a resilient arm provided at the disc portion of the toner conveying shaft, and a protrusion block disposed at a terminal end of the resilient arm and insertable into the notch.

4. The toner cartridge as claimed in claim 2, wherein the resilient portion of the percussion device comprises a resilient member and a knocking member; the resilient member is disposed between the disc portion of the toner conveying shaft and the knocking member in a way that the knocking member is partially insertable into the notch.

5. The toner cartridge as claimed in claim 4, wherein the disc portion of the toner conveying shaft is provided with a radially extending rod, onto which the resilient member is sleeved.

6. The toner cartridge as claimed in claim 2, wherein the disc portion of the toner conveying shaft comprises an arc rim and a plurality of spokes connected between the arc rim and the shaft portion of the toner conveying shaft.

7. The toner cartridge as claimed in claim 1, wherein the barrel portion of the housing comprises a tube body and an end cap disposed to an end of the tube body; the annular flange is provided at the end cap.

8. A toner cartridge, comprising:

a housing having a barrel portion and a transmission portion rotatably disposed at an end of the barrel portion;

a toner conveying shaft rotatably disposed inside the barrel portion of the housing and driven by the transmission portion of the housing to rotate;

a percussion device configured to intermittently vibrate the barrel portion of the housing when the toner conveying shaft rotates;

wherein the barrel portion of the housing comprises an annular flange extending along an axial direction of the barrel portion of the housing; the toner conveying shaft comprises a shaft portion and a disc portion disposed at an end of the shaft portion and rotatably received in the annular flange; the percussion device comprises a notch recessed radially from a periphery of the disc portion of the toner conveying shaft, and a resilient portion provided at the annular flange; when the toner conveying shaft rotates relative to the barrel portion of the housing, a terminal end of the resilient portion intermittently extends into the notch, thereby vibrating the barrel portion of the housing.

9. The toner cartridge as claimed in claim 8, wherein the resilient portion of the percussion device comprises a resilient arm provided at the annular flange, and a protrusion block disposed at a terminal end of the resilient aim and insertable into the notch.

10. The toner cartridge as claimed in claim 8, wherein the disc portion of the toner conveying shaft comprises a circular rim and a plurality of spokes connected between the circular rim and the shaft portion of the toner conveying shaft.

11. The toner cartridge as claimed in claim 8, wherein the barrel portion of the housing comprises a tube body and an end cap disposed to an end of the tube body; the annular flange is provided at the end cap.

* * * * *